US007727128B2

(12) United States Patent
Giannelli et al.

(10) Patent No.: US 7,727,128 B2
(45) **Date of Patent: *Jun. 1, 2010**

(54) LEG PRESS MACHINE

(75) Inventors: Raymond Giannelli, Franklin, MA (US); Stephen C. Wendt, Owatonna, MN (US); Scott Lee, Pomfret, CT (US); Scott Sechrest, Providence, RI (US); Gary Lurken, Owatonna, MN (US); Arnold B. Gillen, Fairbault, MN (US)

(73) Assignee: Cybex International, Inc., Medway, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/582,751

(22) Filed: Oct. 18, 2006

(65) Prior Publication Data

US 2007/0037673 A1 Feb. 15, 2007

Related U.S. Application Data

(63) Continuation of application No. 10/378,289, filed on Mar. 3, 2003, now abandoned, and a continuation-in-part of application No. 09/789,071, filed on Feb. 20, 2001, now Pat. No. 6,743,158.

(60) Provisional application No. 60/361,617, filed on Mar. 4, 2002, provisional application No. 60/186,138, filed on May 9, 2000.

(51) Int. Cl.

| | |
|---|---|
| ***A63B 23/04*** | (2006.01) |
| ***A63B 21/062*** | (2006.01) |
| ***A63B 21/068*** | (2006.01) |

(52) U.S. Cl. ..... 482/101; 482/96; 482/135; 482/142

(58) Field of Classification Search ..... 482/72, 482/92–101, 135–137, 142, 145; 297/261.1, 297/259.2

See application file for complete search history.

(56) References Cited

U.S. PATENT DOCUMENTS

| | | | | |
|---|---|---|---|---|
| 209,377 | A | | 10/1878 | Britt |
| 2,183,345 | A | | 12/1939 | Brandon |
| 2,733,922 | A | * | 2/1956 | Diego ..... 482/96 |
| 3,219,341 | A | | 11/1965 | Weinstein |
| 3,573,865 | A | | 4/1971 | Annas et al. |
| 3,622,154 | A | | 11/1971 | Williams |
| 4,043,552 | A | | 8/1977 | Kerkonian |
| 4,176,836 | A | | 12/1979 | Coyle |
| 4,700,946 | A | | 10/1987 | Breunig |
| 4,828,254 | A | | 5/1989 | Magg |
| 4,915,378 | A | | 4/1990 | Abrahamian et al. |
| 5,106,080 | A | | 4/1992 | Jones |
| 5,260,870 | A | | 11/1993 | Tsuchiya et al. |

(Continued)

*Primary Examiner*—Loan H Thanh
*Assistant Examiner*—Victor K Hwang
(74) *Attorney, Agent, or Firm*—Rissman Hendricks & Oliverio, LLP

(57) ABSTRACT

A leg press exercise machine that provides translational and rotational motion of the user support structure by translating the user support structure along two intersecting non-orthogonal linear paths. A front portion of the user support structure travels along an inclining linear path and a rear portion of the user support structure travels along a declining linear path. The translation of the user support structure along the inclining and declining linear paths results in the user support structure exhibiting a rational motion, defining an arcuate path.

22 Claims, 9 Drawing Sheets

U.S. PATENT DOCUMENTS 5,273,503 A * 12/1993 Hershey ..... 482/96
5,334,120 A 8/1994 Rasmussen
5,411,458 A 5/1995 Giust
5,437,589 A 8/1995 Habing
5,484,365 A 1/1996 Jones et al.
5,554,086 A 9/1996 Habing et al.
5,595,558 A * 1/1997 Moon ..... 482/72
5,616,107 A 4/1997 Simonson
5,628,715 A 5/1997 Simonson
5,964,684 A 10/1999 Sokol
6,220,993 B1 4/2001 Sencil
6,287,241 B1 9/2001 Ellis
6,605,024 B2 * 8/2003 Stearns ..... 482/142
6,743,158 B2 * 6/2004 Giannelli et al. ..... 482/96
6,916,278 B2 * 7/2005 Webber ..... 482/96
7,004,891 B2 * 2/2006 Morris et al. ..... 482/101
7,052,444 B2 * 5/2006 Webber ..... 482/93
7,220,221 B2 * 5/2007 Mosimann et al. ..... 482/100
2004/0209749 A1 * 10/2004 Planit ..... 482/121
2005/0032611 A1 2/2005 Webber et al.
2005/0096196 A1 * 5/2005 Webber et al. ..... 482/94

* cited by examiner

LEG PRESS MACHINE

CROSS-REFERENCE TO RELATED APPLICATION

This application is a continuation of U.S. patent application Ser. No. 10/378,289, filed Mar. 3, 2003, now abandoned, which is related to and claims priority to U.S. Provisional Patent Application Ser. No. 60/361,617, filed Mar. 4, 2002, entitled LEG PRESS MACHINE, and is a continuation-in-part (CIP) of U.S. patent application Ser. No. 09/789,071, filed Feb. 20, 2001 (now U.S. Pat. No. 6,743,158, issued Jun. 1, 2004), entitled LEG PRESS MACHINE, which is related to and claims priority to U.S. Provisional Patent Application Ser. No. 60/186,138, filed May 9, 2000, entitled LEG PRESS MACHINE, the entirety of which are incorporated herein by reference.

STATEMENT REGARDING FEDERALLY SPONSORED RESEARCH OR DEVELOPMENT n/a

FIELD OF THE INVENTION

The present invention relates to the field of exercise and physical rehabilitation equipment, and in particular to apparatus for exercising the legs and lower torso.

BACKGROUND OF THE INVENTION

It is often necessary or desirable for a person to exercise a particular muscle or group of muscles, such as to recover from surgery or injury, to increase strength, stamina and endurance, and to maintain an active and healthy lifestyle, as well for aesthetic purposes. Various machines have been developed to exercise different muscles and muscle groups by forcing the muscles to contract and extend under a load, such as by moving a free weight against the force of gravity or by moving an object whose movement is resisted by resistance force, such as a, spring or a weight attached to a cable and pulley system.

One exercise that has been developed to exercise the leg muscles is known as the leg press. A leg press involves a pushing motion wherein a person pushes with his/her feet and legs to extend the legs from a hip and knee flexed starting position to a hip and knee extended finishing position, thereby contracting the muscles in the legs and lower torso, namely the quadriceps, gluteal, and calf muscles, as well as any ancillary muscles involved in such a motion.

A typical leg press machine includes a footplate and a seat. A user sits in the seat, generally facing opposite the footplate, applies force to the footplate in the leg press motion, which is typically a compound motion of the hip and knee pushing the footplate away from the user's torso. This force is countered by the force generated by the hip and knee applied through the torso against the seat, rendering the body relatively motionless with respect to a fixed frame such as the ground. As the legs extend, either the footplate or the seat (or both) is moved, generally in a somewhat linear path, allowing the exercise motion to proceed. A resistance device is coupled to the moving elements to provide the necessary resistance.

Currently, leg press exercise machines having features similar to those disclosed in Jones, U.S. Pat. No. 5,106,080, and Simonson et al., U.S. Pat. No. 5,263,914, include an adjustable seat for accommodating users having different body sizes and leg lengths. The position of the seat relative to the footplate is adjusted prior to the commencement of exercise such that the user can exercise over a full range of motion. Alternatively, the footplate may be disposed at various initial positions with respect to a fixed seat.

In known leg press machines, the motion of the moving portion of the machine is generally fixed to one linear or rotational degree of freedom. Thus, when the leg press exercise is executed, the body or the machine move in a generally linear, straight translational motion or a single axis rotational motion. This results in an exercise which mostly stresses the quadricep muscle group in the leg, but does not fully engage various other muscle groups in the hips and lower torso, which are often integral to the motion of the lower body. Examples of such muscle groups are the hip extensor and lower back muscles.

It is desirable therefore, to provide an exercise machine for the legs, which also incorporate a means by which the hips and lower back muscles may be exercised to a higher intensity and with a greater range of motion, in addition to the muscles exercised by a traditional leg press.

SUMMARY OF THE INVENTION

The present invention provides an exercise apparatus, particularly for leg presses and in which the apparatus is relatively simple in construction, relatively inexpensive, and provides for the maintaining of a more optimized body position throughout the transition from a start position to an extended position and back. This optimized body positioning allows for the rearward rotation of the torso as it translates through the path of motion, to allow for a substantially increased range of motion of the user's hip during the exercise. In accordance with one aspect of the present invention, there is provided a reversibly extending exercising apparatus that comprises a first arm and a second arm pivotably interconnected to each other such that the interconnected arms are pivotably movable between a start position and an extended position. The first arm may be pivotably supported from an apparatus frame, while the second arm is slidably or rollably supported on a support guide mechanism. In this way, the second arm is supported for movement along a predetermined path of travel, preferably inclined relative to horizontal, between the start and extended positions.

In accordance with another aspect of the present invention, there is provided a leg press exercise apparatus that comprises a frame, a rest member on the frame for receiving and supporting a user's feet, and a first arm and a second arm that are pivotably intercoupled to each other such that the arms are pivotably movable between a start position and an extended position. The first arm is coupled to the frame, preferably adjacent of the rest member. A seat is provided for supporting the user and is carried by the second arm. An incline base support member is disposed under the second arm and is for supporting this second arm during the movement between start and extended positions.

In accordance with the invention there is also provided an apparatus comprising: a frame; a rest member on said frame for receiving a user's feet; a first arm and a second arm that are pivotably intercoupled to each other such that the arms are pivotably movable between a start position and an extended position; said first arm coupled to said frame; a seat for supporting a torso of the user and carried by said second arm; and an inclined base support member disposed under said second arm for supporting the second arm during movement between the start and extended positions. The first arm is pivotably coupled to said frame, the second arm following the inclined base support between the start and extended positions such that the torso of the user is rotated rearwardly relative to horizontal during movement between the start and extended positions. The frame includes an upright support piece having at the top end thereof a pivot member for coupling said first arms to said frame. The apparatus includes a pivot member for intercoupling the first and second arms such that the torso of the user is translated rearwardly away from the rest member during movement between the start and extended positions. The apparatus includes a carriage supported on said inclined base support member wherein the carriage at one end thereof includes a pivot member for pivotally supporting the carriage from said second arm. The carriage typically comprises spacedly disposed side plates interconnected by a lower guide member and an upper guide member.

Further in a accordance with the invention there is provided a reversibly extending exercise apparatus comprising: a pair of pivotably interconnected arms on which a subject is mountable on a chair mechanism; a support and guide mechanism forming a part of a frame of the apparatus; wherein the support and guide mechanism support one of the pair of pivotably interconnected arms; wherein the arms are reversibly extendible by forcible extension of the legs of the subject between a rest position and an extended position; the arms being extendible such that the subject is positioned in an upwardly prone position at all times between the rest and extended position In an alternative embodiment of the leg press machines of the present invention, the carriage assembly is mounted to the frame, so as to move along on a pair of intersecting non-orthogonal paths. The carriage assembly is adapted to be moved from a first position to a second position along the non-orthogonal planes, defining an arcuate path. The seat and backrest decline as the carriage assembly travels from the first position to the second position, placing the hips in minimal flexion. Similarly, the seat and backrest incline as the carriage assembly travels from the second position to the first position.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

Figure 1:
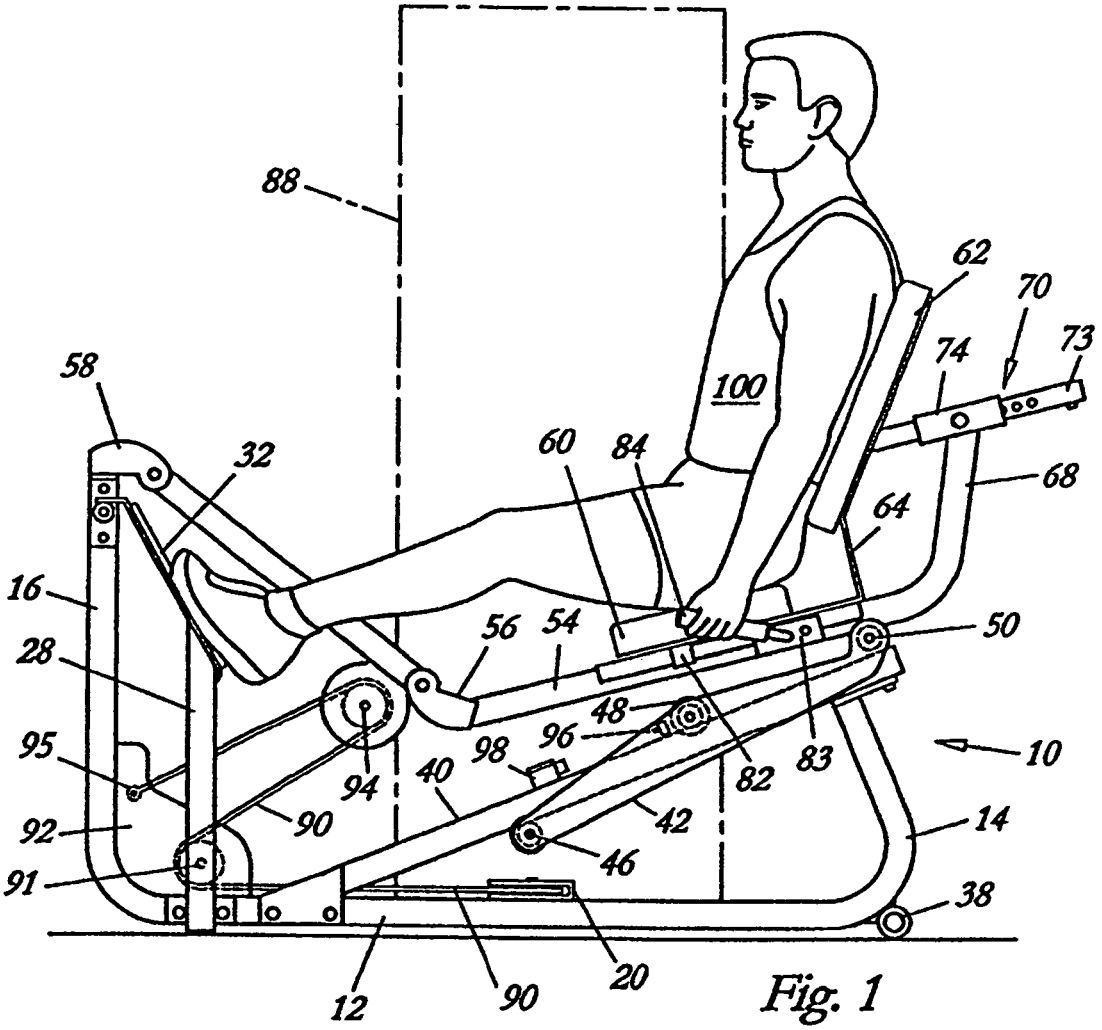
FIG. 1 is a side elevation view of an embodiment of the exercise apparatus of the present invention.
Figure 2:
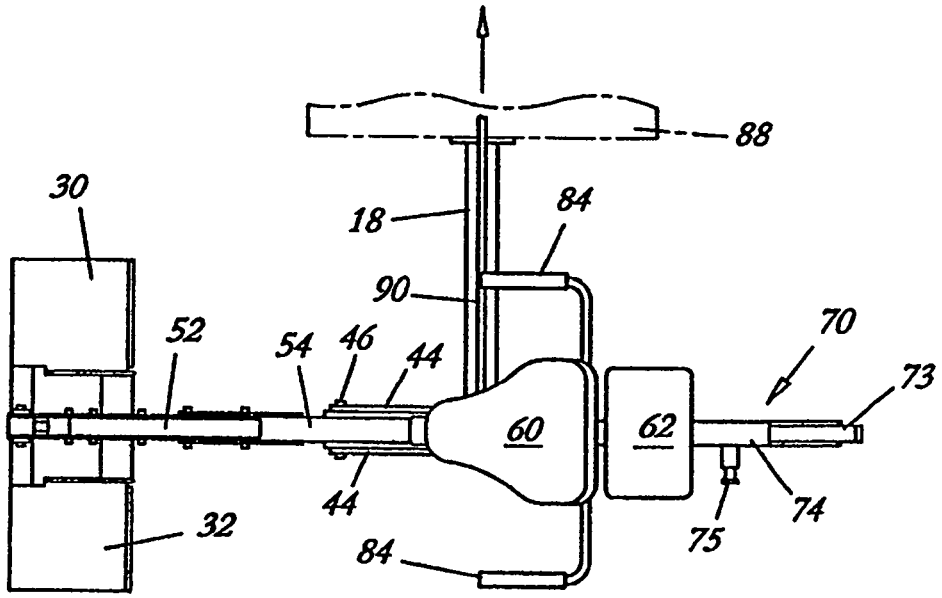
FIG. 2 is a top plan view of the exercise apparatus of FIG. 1.
Figure 3:
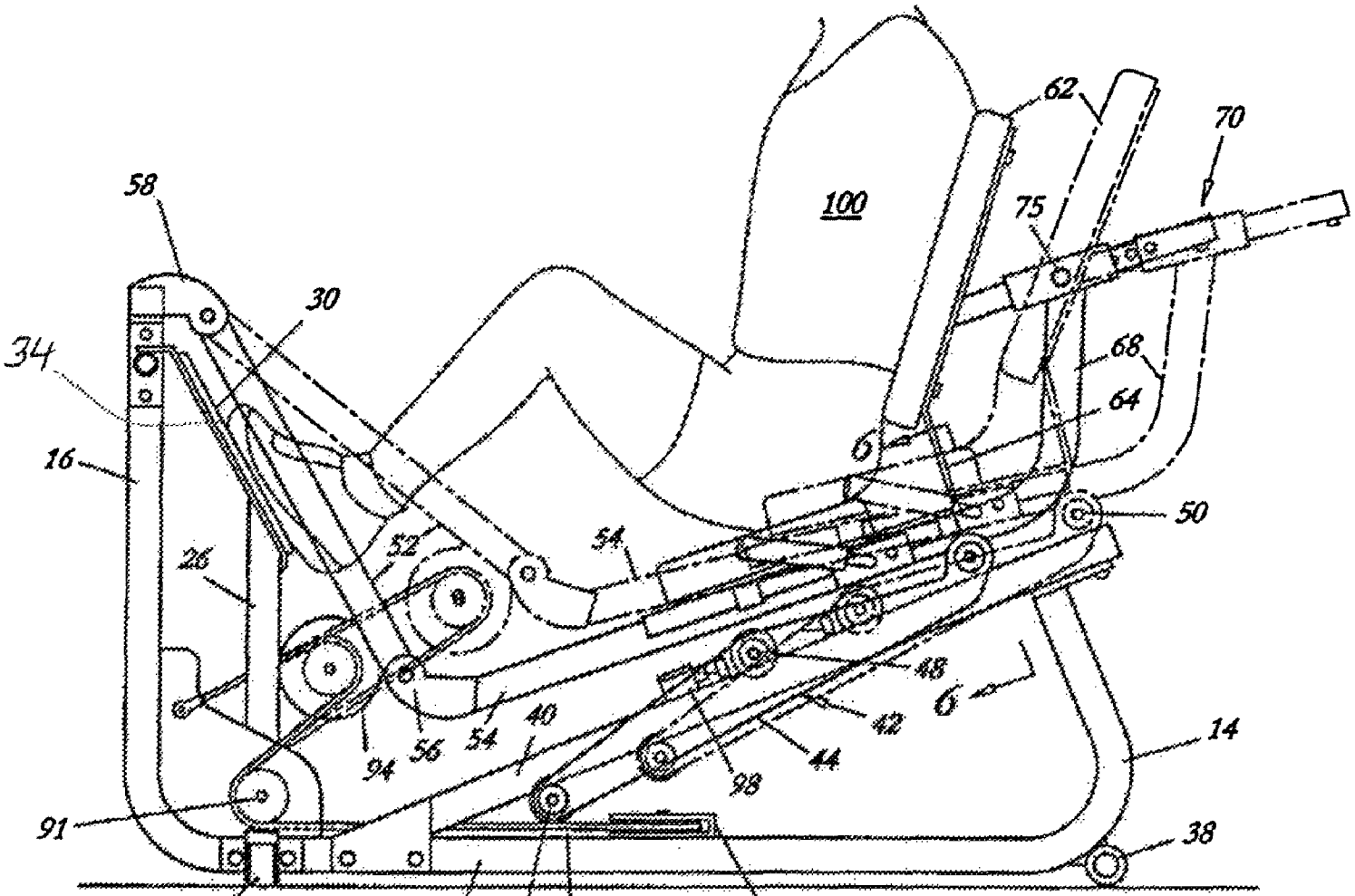
FIG. 3 is an enlarged side elevation view of the apparatus disclosed in FIGS. 1 and 2 and showing the apparatus in rest and extended positions.
Figure 6:
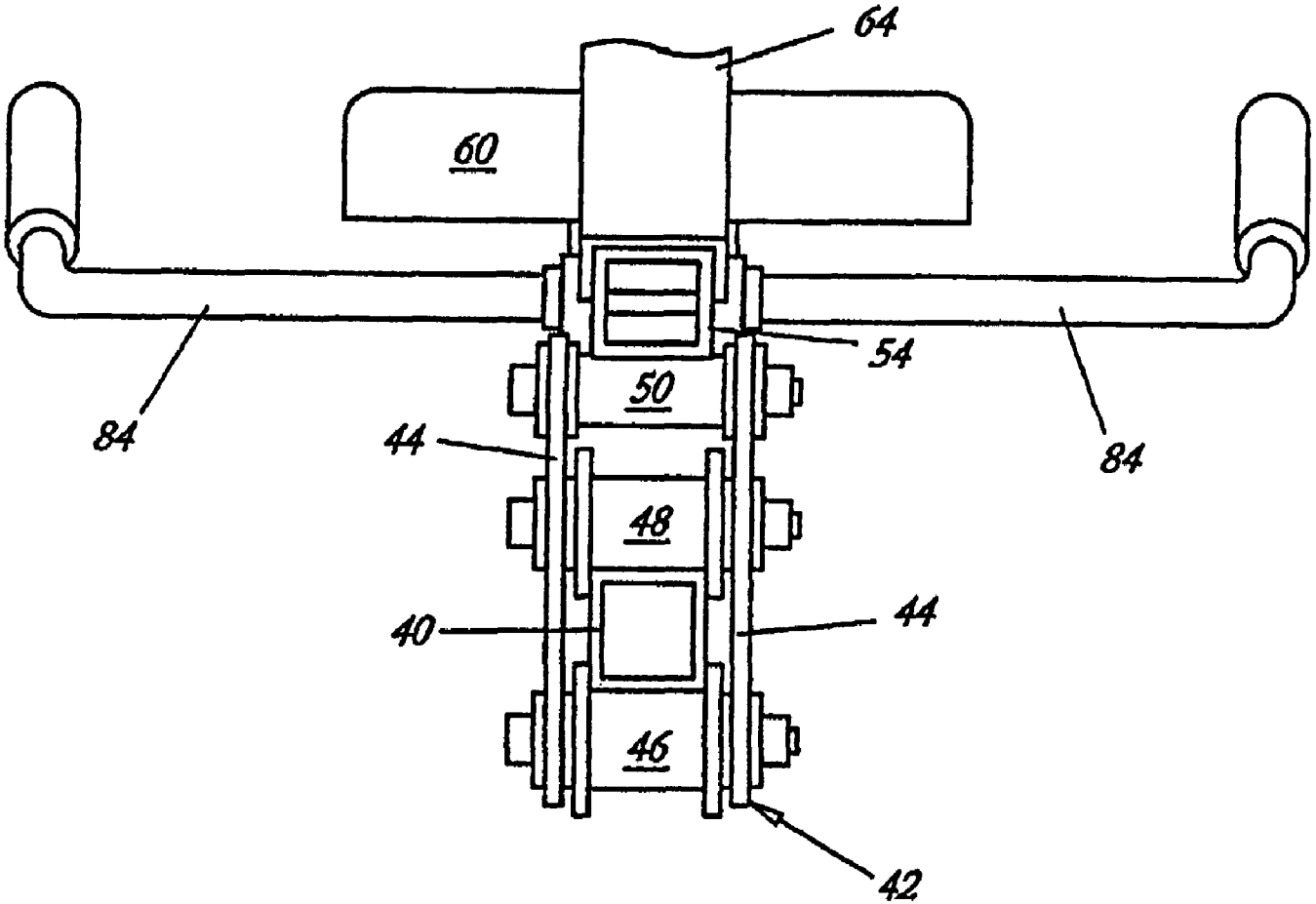
Figure 7A:
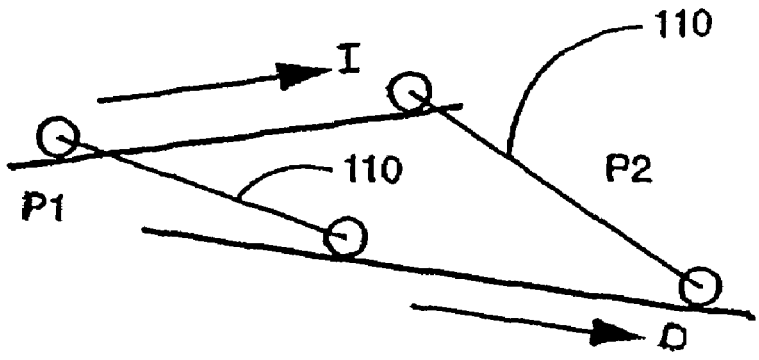
Figure 7B:
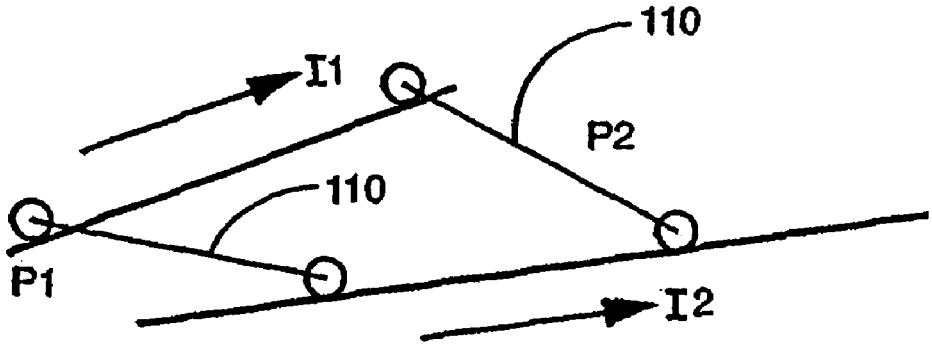
Figure 8:
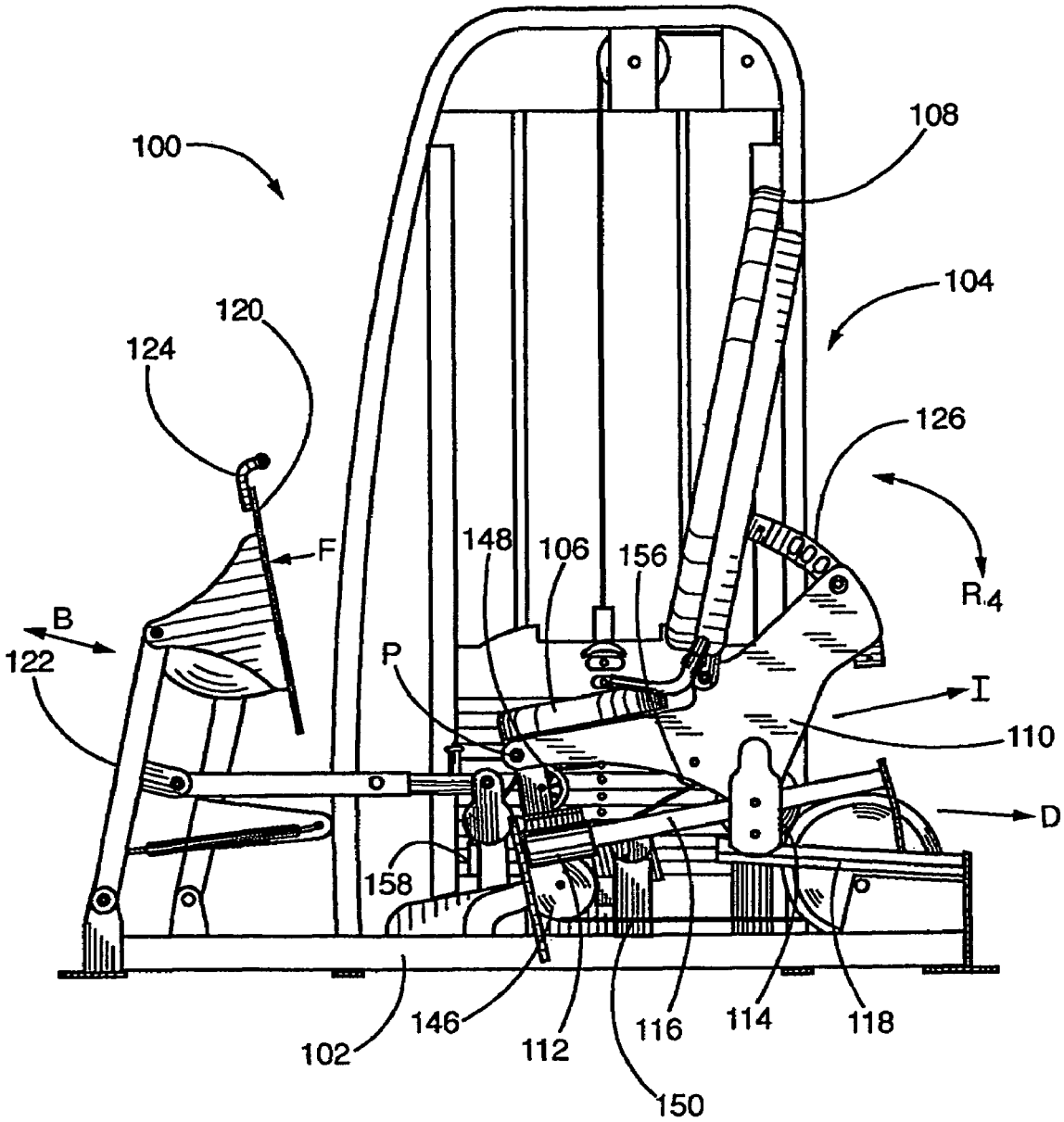
Figure 9:
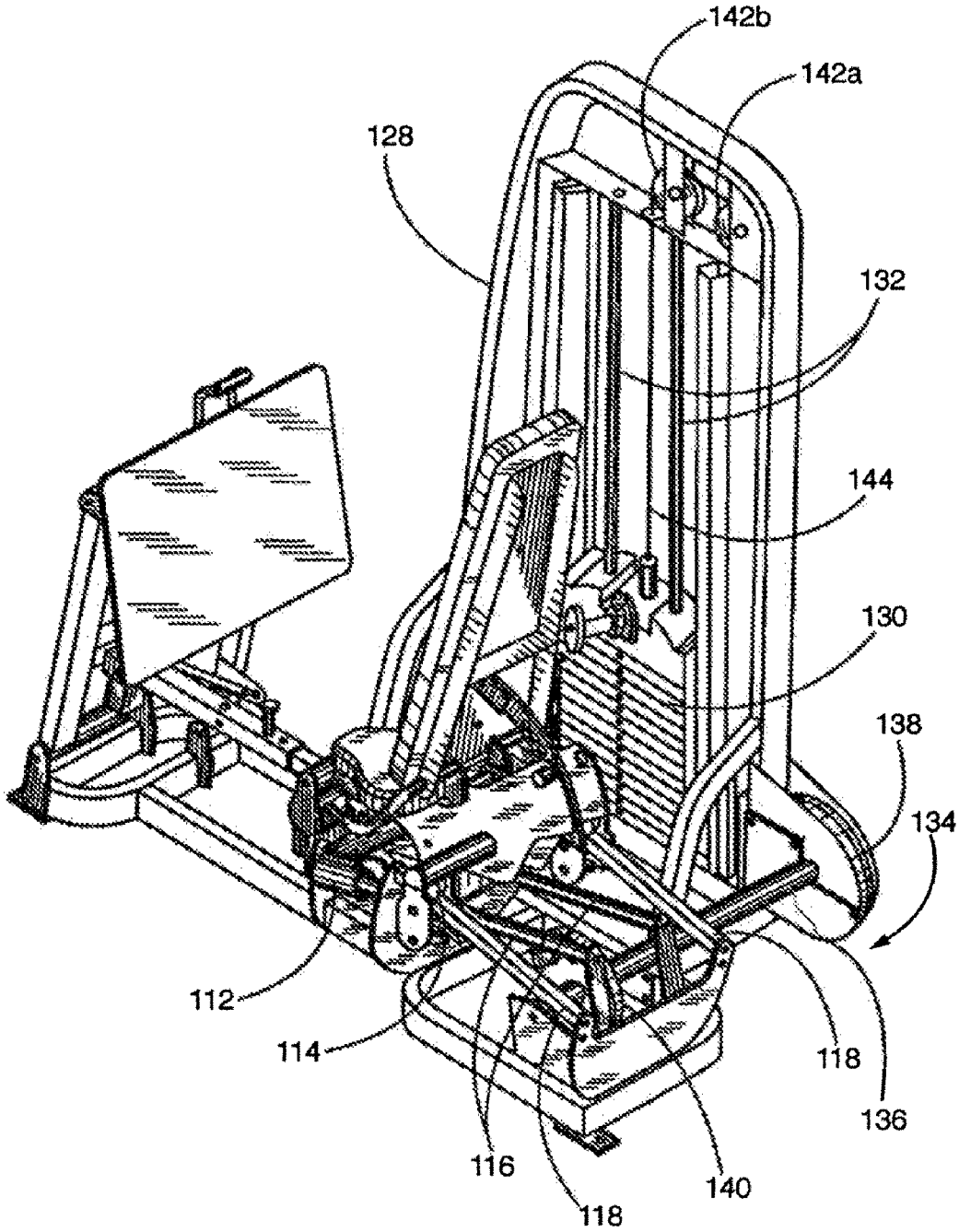
Figure 10:
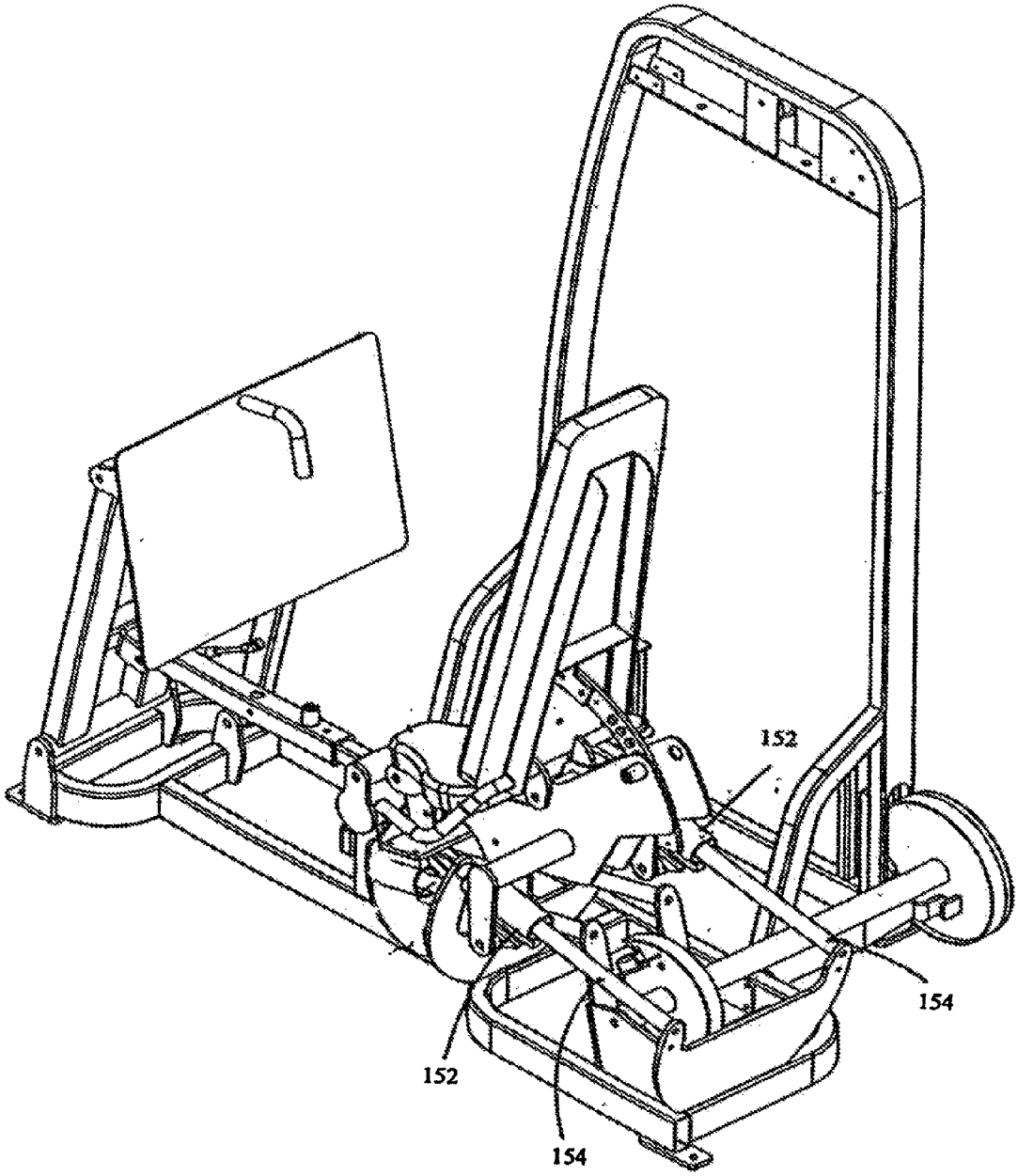

FIG. S is a somewhat schematic view of the exercise apparatus similar to that depicted in FIG. 3, but showing further cutaway details;

FIG. 6 is a cross-sectional view of the apparatus of FIG. 3 as taken along line 6-6 of FIG. 3;

FIGS. 7A-7B are schematic representations of pairs of intersecting, non-orthogonal linear paths;

FIG. 8 is a side elevation view of a second exemplary embodiment of the exercise apparatus of the present invention;

FIG. 9 is a perspective view of a second exemplary embodiment of the exercise apparatus of the present invention; and FIG. 10 is a perspective elevation view of a third exemplary embodiment of the exercise apparatus of the present invention.

DETAILED DESCRIPTION OF THE INVENTION

The subject invention provide's a leg press machine for exercising the leg muscles, including the quadriceps, hamstring, calf, and gluteus muscles. The leg press machine includes a user support structure sliding mounted to a frame, wherein the user support structure is capable of both translational and rotational motion. The translational and rotational motion of the user support structure induces significantly greater extension of the hips of a user when the user's legs are extended, thereby increasing the exercise intensity and range of motion of the hip extensors and lower torso muscles.

Reference is now made to the drawings herein, particularly FIGS. 1-6 which illustrate an exemplary embodiment of the leg press apparatus of the present invention. The apparatus comprises a frame 10 preferably constructed of metal. The frame is comprised of a number of different components, many of which are of square or U-shaped metal cross section. The frame 10 includes an elongated base piece 12 having at one end a curved section 14 and at its other end connects to an upright support piece 16. An extension member 18 is secured at about the middle of base piece 12 as noted in, for example, FIG. 4. A pulley 20 is supported at a position where the extension member 18 is secured to the base piece 12.

At the end of the base piece 12 where the upright support piece 16 is secured, there is also provided a U-shaped support member 24. Member 24 has upstanding support members 26 and 28. These support members 26 and 28, at the respective tops thereof, support footplates 30 and 32. Each of these footplates 30 and 32 may carry a non-skid surface 34, such as shown in either FIG. 1 or FIG. 3.

To stabilize the apparatus, frame 10 and its various members employ stabilizer feet. These are in the form of cylindrical members 38. These are shown, for example, in FIG. 4, two being attached to the U-shaped support member 24, and one being attached to the frame between the base piece 12 and the curved section 14. The stability of the apparatus is also enhanced by the extension member 18 extending from the base piece 12.

An inclined support member 40 is provided. Member 40 extends from the base piece 12 to the top of the curved section 14. The inclined support member 40 functions as a fixed rail for the carriage 42.

The carriage 42 comprises two side plates 44, one disposed on each side of the incline support member 40. These side plates are interconnected by a lower guide member 46 and by an upper guide member 48. The carriage 42 is also pivotably connected to the arm structure which is to be described in further detail hereinafter. This connection, as noted in the figures, is at pivot 50.

As indicated previously, in addition to the frame 10 and rest members, namely foot plates 30 and 32, there is also provided a pair of arms that are pivotably interconnected to each other such that the arms are pivotably movable between a start position and an extended position. In the drawings, these are identified as arms 52 and 54. These arms 52 and 54 are interconnected at a common end at the pivot member 56. The top end of arm 52 is also pivoted at pivot member 58 such as shown in the somewhat schematic diagram of FIG. 5. Pivot 58 is secured at the top of the upright support piece 16. Refer also to the enlarged side elevation view of FIG. 3 which shows the pivot member 58 with the arms 52 and 54 in solid and dotted position indicating two different positions of the linkage arms.

Figure 4:
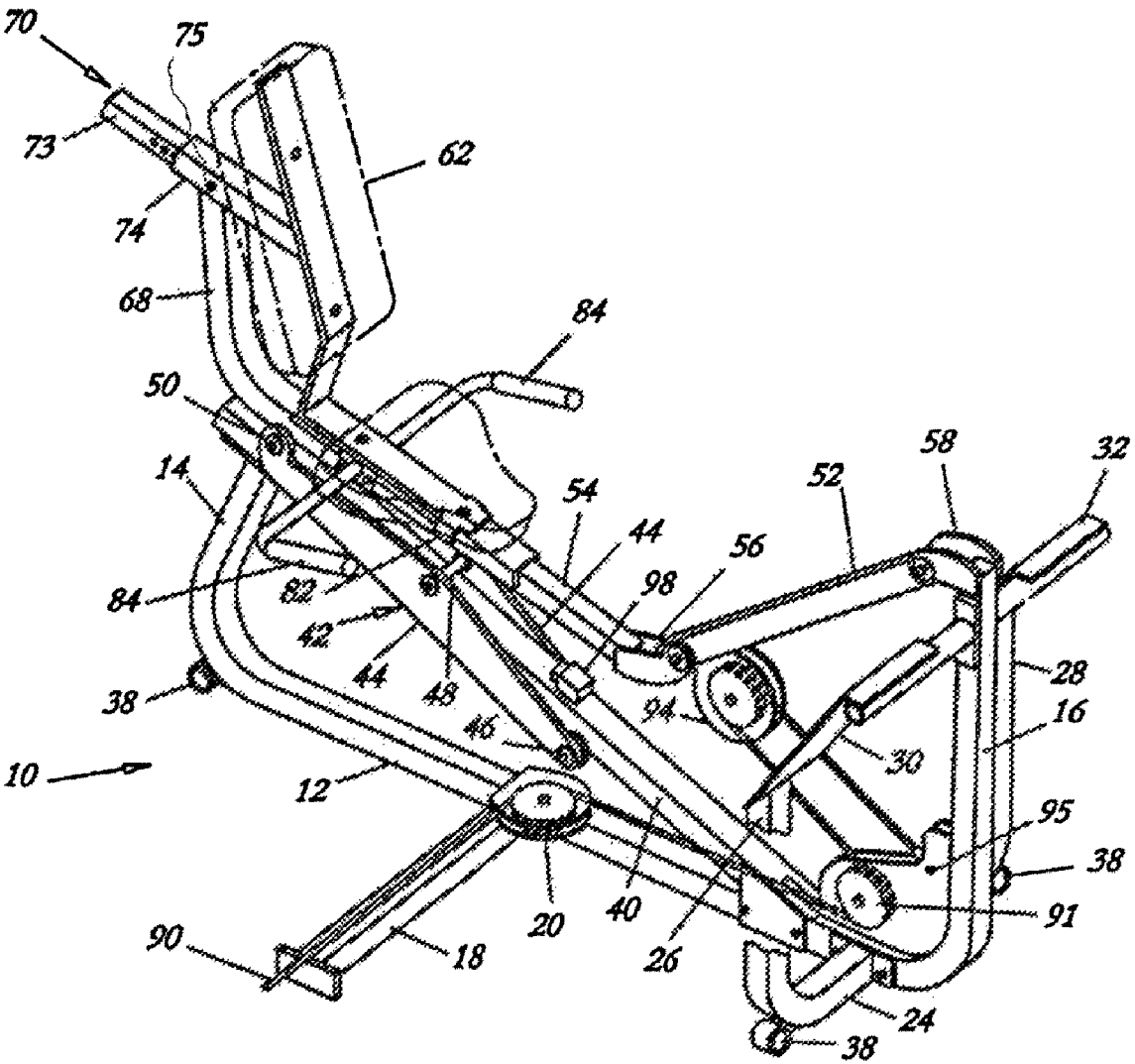
FIG. 4 is a perspective view of the exercise apparatus of the present invention with the apparatus in its extended position, but with the seat removed for clarity.
Figure 5:
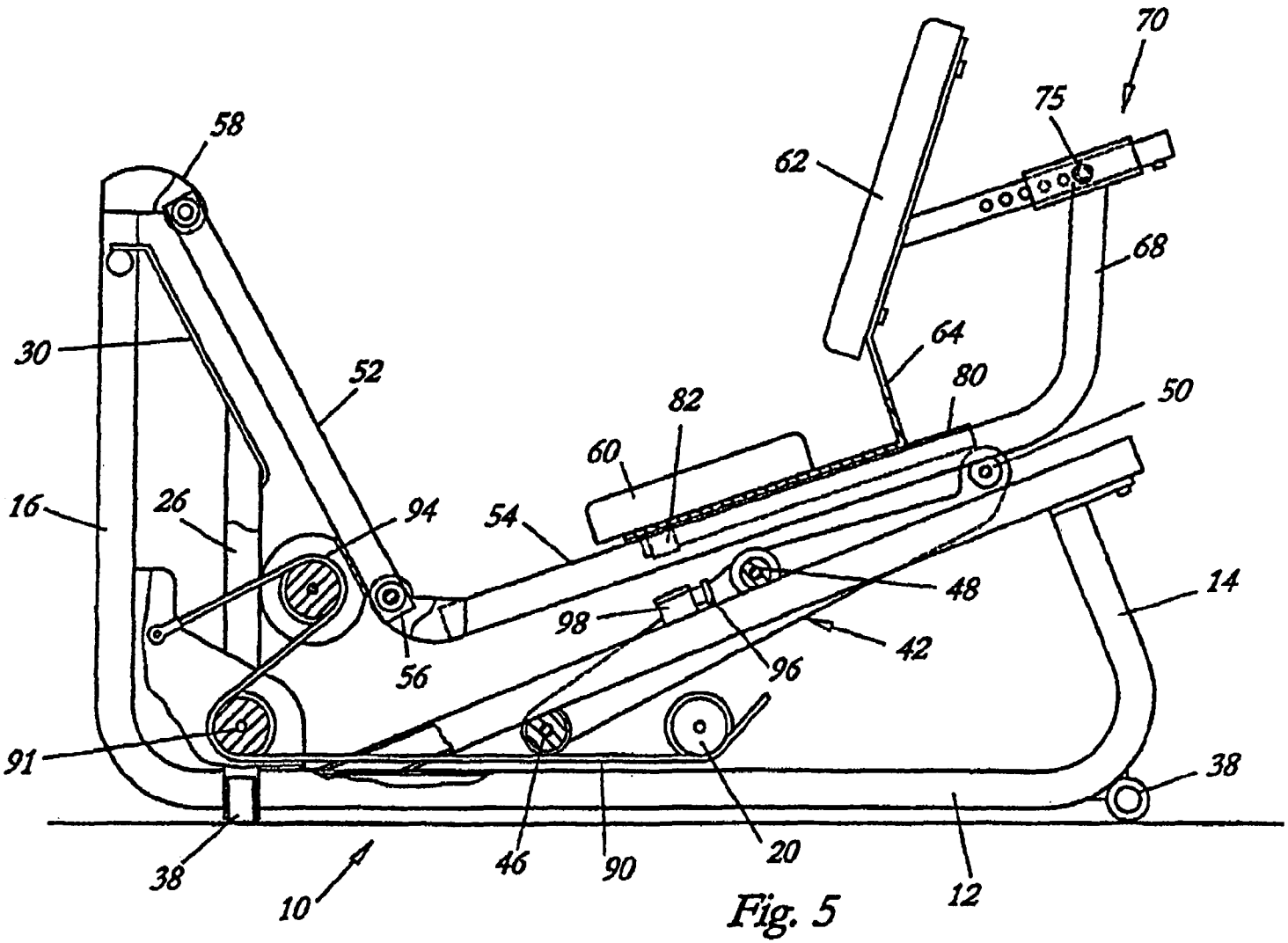

Also included in the apparatus of the present invention is a seat 60 and its associated backrest 62 attached or rigidly connected to arm 54 such that pivoting of the arm 54 simultaneously pivots seat 60 and backrest 62. A plate 64 may be used for commonly supporting the seat 60 and the backrest 64 such as indicated in FIG. 5. A reference may also be made to the perspective view of FIG. 4 which shows the plate 64 and the seat 60 and the backrest 62 in dotted outline.

It is also noted from the drawings that the arm 54 has an upturned end 68 that supports at its top end an adjustment bar 70 that is affixed to the plate 64 and may be used for adjusting the position of the seat and backrest. For this purpose, the adjustment bar 70 includes an inner-member 73 and an outer-member 74. The inner-member 73 is provided with holes into which a pin 75 may be inserted so as to hold the seat and backrest in any one of a number of positions along the arm 54. The pin 75 may be a spring loaded pin for adjusting seat position. As also noted in FIG. 5, there may be a slidable channel or plate 80 disposed between the plate 64 and the arm 54 so as to enable the seat mechanism to slide readily on the arm 54. The member 80 may be constructed, for example, of Teflon. For proper support of the seat and backrest, there are also provided side guides 82, such as illustrated in FIGS. 4 and 5. Furthermore, at one of the guides 83, there is disposed outwardly on either side of the arm 54, handlebars 84. In this regard, also note FIG. 1 which shows the user 100 in a seated position on the seat 60 with his back against the backrest 62 and with his hand grasping one of the handlebars 84, that is the one that is visible in FIG. 1.

Now, with further regard to the drawings, and in particular, the perspective view of FIG. 4, there is clearly shown the cable arrangement for providing the resistance to the user. In this regard, for example, in FIGS. 1 and 2, there is shown in dotted outline a multi-station apparatus 88 to which the extension member 18 may be coupled, as indicated, in FIG. 2. A cable 90 may connect in the machine 88 to weights or some other mechanism for providing resistance. But, as indicated, for example, in FIG. 4 of the present application, the cable 90 extends about pulley 20 and from there to a further pulley 91. Pulley 91 is supported between spaced brackets 92 of the frame 10. From there, the cable 90 extends to a further pulley 94 that is rotatable but has its supporting housing fixed directly to arm 52. The cable 90 extends to about pulley 94 and then is secured by means of a pin 95 between the spaced brackets 92. Depending upon the amount of weight that is selected or other form of resistance that is used, as the user moves from the rest position toward an extended position, the weight and cable mechanism impose a force on the user to carry out the exercise in muscle strengthening.

Reference may now be made to FIG. 3 that shows, in solid outline, the arms 52 and 54 in a rest position. In this position, the stop plate 96 is resting against the elastomeric stop 98. FIG. 3 also shows, in phantom outline, the arms 52 and 54 pivoted to a more extended position. This would also be similar to the position of the apparatus depicted in the perspective view of FIG. 4 where it is noted that the stop plate 96 is spaced away from the stop 98. FIG. 5 shows the apparatus in its rest position also with the stop 98 engaging the plate 96.

With further reference to FIG. 3, it should also be noted that as the arm 54 moves from the solid position (initial) to the dotted position (extended) in FIG. 3, the attitude of the arm 54 and the seat 60/backrest 62 mounted on the arm 54 and changes relative to the horizontal. This provides a comfortable body position as the user provides leg press action between initial and extended positions. Because the arm 54 is secured at pivot 50, the carriage 42 simply transitions along rail 40 such as between the two positions illustrated in FIG. 3 and the arm 54, seat 60 and backrest 62 pivot backwardly.

With regard to the diagram of FIG. 5, this also clearly indicates the position of the arm 54 in its rest position with the carriage being against a stop. FIG. 5 also illustrates the cable 90 and its transition around the pulleys. It is noted in FIG. 5, that the pulley 20 is shown, for the sake of illustration, vertically disposed when, in actuality, it is horizontally disposed such as illustrated in FIG. 3.

In an alternative embodiment of the leg press exercise machine, the translation and rotation of the user support structure is achieved by translating the user support structure along two intersecting non-orthogonal linear paths. For example, a front portion of the user support structure can travel along a first linear pal d a rear portion of the user support structure can travel along a second linear path. The translation of the user support structure along the first and second linear paths results in the user support structure exhibiting a rotational motion, defining an arcuate path. As shown in FIG. 7A, the front portion of the user support structure 110 travels along a first linear path "I" and the rear portion of the user support structure 110 travel along second linear path "D." When the user support structure 110 moves from a first position "P1" to a second position "P2" the front portion travels to the apex of the first linear path "I" and the rear portion travel to the nadir of the second linear path "D." Similarly, when the user support structure 110 moves from the second position "P2" to the first position "P1" the front portion travels to the nadir of the first linear path "I" and the rear portion travel to the apex of the second linear path "D." The translation of the user support structure 110 along the first linear path "I" and second linear path "D" results in the user support structure 110 exhibiting a rotational motion, defining an arcuate path.

Alternatively, as shown in FIG. 7B, the front portion of the user support structure 110 travels along a first liner path "I1" and the rear portion of the user support structure travel 110 along second linear path "I2." When the user support structure 110 moves from a first position "P1" to a second position "P2" the front portion travels to the apex of the first linear path "I1" and the rear portion travel to the apex of the second liner path "I2." Similarly, when the user support structure 110 moves from the second position "P2" to the first position "P1" the front portion travels to the nadir of the first linear path "I2" and the rear portion travel to the nadir of the second liner path "I2." The translation of the user support structure 110 along the first linear path "I1" and second linear path "I2" results in the user support structure 110 exhibiting a rotational motion, defining an arcuate path.

Referring to FIGS. 8 and 9 the leg press machine, labeled generally as 100, includes among other elements, a frame 102 and a user support structure 104 slidingly mounted to the frame 102. The user support structure 104 includes a seat 106 and a backrest 108. The seat 106 and backrest 108 are mounted to a carriage assembly 110, which includes a pair of front slide bearings 112 and a pair of rear rollers 114. The carriage assembly 110 is mounted to the frame 102, wherein the front slide bearings 112 are coupled one each about a pair of shafts 116, such that the front portion of the carriage assembly 110 is translatable along a first linear path "I." The rear rollers 114 are positioned on and engagable with a pair of frame rails 118, such that the rear portion of the carriage assembly 110 is translatable along a second linear path "D," where the first linear path and the second linear path are intersecting non-orthogonal paths.

The front portion of the carriage assembly 110 is pivotally coupled to the front slide bearings 112, such that the carriage assembly 110 is pivotable about point "P." As the front and rear portions of the carriage assembly 110 translate along paths "I" and "D," the carriage assembly 110 pivots about point "P." The translational and rotational motions of the carriage assembly 110 define an arcuate path, where the seat 106 and the backrest 108 rotate along the arcuate path.

In use, as shown in FIG. 8, a user's legs are extended by applying a force "F" to a footplate 120, where the force "F" is sufficient to overcome a machine resistance. The user support structure 104 travels away from the footplate 120, with the front of the carriage assembly 110 translating along first linear path "I" to an apex, and the rear portion of the carriage assembly 110 translates along the second linear path "D" to a nadir. The carriage assembly 110 pivots about point "P," where the seat 106 and the backrest 108 rotate, reclining along the arcuate path. The user's legs are contracted by decreasing the force "F" until the force "F" is less than the machine resistance. The user support structure 104 travels towards from the footplate 118, with the front of the carriage assembly 110 translating along first linear path "I" to a nadir, and the rear portion of the carriage assembly 110 translates along the second linear path "D" to an apex. The carriage assembly 110 pivots about point "P," where the seat 106 and the backrest 108 incline along the arcuate path, to the start position.

The footplate 120 and backrest 108 are adjustable to accommodate a user's specific body size and shape. The footplate 120 is adjusted using the footplate adjustment mechanism 122, a four-bar linkage which allows a user to adjust the fixed position of the footplate 120 in the direction "B." The footrest adjustment lever 124 is coupled to the footplate 120 to allow a user to adjust the footplate 120 while seated and ready to perform the leg press motion. The backrest 108 is adjustable in the direction "$R_4$" via the backrest support 126. The backrest support 126 is an arcuate element having several apertures there though, and is fixed at one end to the backrest 108, and at the other end to the carriage assembly 110. The backrest 108 is adjusted by sliding the backrest support 126 along the direction $R_4$ and selectably engaging one of its apertures.

In an embodiment, the machine resistance is provided by a weight stack operably connected to the user support structure 102. Referring to FIG. 9, a weight stack brace 128 is attached to the support frame 102, such that the weight stack 130 is easily accessible by a user positioned in the user support structure 104. Rails 132 are mounted vertically within the weight stack brace 128, where the weight stack 130 is slidingly mounted to the rails 132.

A transmission assembly 134 is interposed between the weight stack brace 128 and the support frame 102, where the transmission assembly 134 includes a shaft 136, a first cam 138, and a second cam 140. A weight stack pulley set 142*a* and 142*b* is mounted to the top of the weight stack brace 128, with pulley 142*a* aligned with the first cam 138 and pulley 142*b* aligned with the weight stack 130. A first connecting structure 144 having a first end and a second end operably connects the first cam 138 to the weight stack 130. The first end of the first connecting structure 144 is connected to the first cam 138, wherein the first connecting structure 144 is threaded about the weight stack pulleys 142*a* and 142*b*, and the second end of the first connecting structure 144 is connected to the weight stack 130.

The second cam 140 is aligned with a frame pulley 146, wherein a first carriages pulley 156 and a second carriage pulley 148 are positioned above the frame pulley 146 on the carriage assembly 110. A second connecting structure 150 having a first end and a second end operably connects the second cam 140 to the carriage assembly 110. The first end of the second connecting structure 150 is attached the second cam 140, where the second connecting structure 150 is threaded about the frame pulley 146 and through the first carriage pulley 156 and the second carriage pulley 148. The second end of the second connecting structure 150 is secured to the frame 102 with clamp 158. As the user support structure 104 is moved from the start position, the carriage assembly 110 pulls the second connecting structure 150, rotating the second cam 140. The rotation of the second cam 150 causes the rotation of the first cam 138, via the shaft 136, raising the weight stack 130. The first connecting structure 144 and the second connecting structure 150 can include belts, cables, ropes, chains, or other related typed devices.

Other mechanisms for providing resistance can also be used, such as friction fitting, springs, elastic bands, hydraulic, pneumatic or electromagnetic resistance, or an air resistance fan could be employed (either alone or in combination) and still practice the invention.

In an alternative embodiment, as shown in FIG. 10, the rear portion of the carriage assembly 110 includes pair of rear slide bearings 152. The rear portion of the carriage assembly 110 is mounted to the frame 102 by coupling the rear slide bearings 152 about the rear shafts 154, such that the rear portion of the carriage assembly 110 is translatable along the second linear path "D."

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A leg press exercise machine for a user comprising:

a frame;

a seat structure mounted to the frame;

the seat structure comprising a seat adapted to support a base of the user's back in a seated position and a backrest extending from and arranged relative to the seat to support an upper extension of the user's back extending from the base of the user's back at a selected angle relative to the seat, the seat structure being adapted to be moved from a first position to a second position by the user's performance of a leg press exercise, the seat structure having a first portion guided along a first linear support and a second portion guided along a second linear support during movement between the first and second positions the supports being arranged along non-orthogonal intersecting linear paths relative to each other that rotates the seat structure as it is guided along the first and second supports.

2. The leg press exercise machine of claim 1 wherein the seat and the backrest and the first and second supports are arranged and adapted to rotate the seat and the backrest during movement of the seat structure between the first and second positions.

3. The leg press exercise machine according to claim 2 wherein the seat and the backrest are pivotably mounted to a carriage mechanism that translates and rotates the seat and the backrest together during movement between the first position and the second position.

4. The leg press exercise machine according to claim 3 wherein the seat and the backrest recline together as the user support structure travels from the first position to the second position.

5. The leg press exercise machine according to claim 3 wherein the seat and the backrest incline together as the user support structure travels from the second position to the first position.

6. The leg press exercise machine of claim 1 wherein the seat and the backrest are adapted to position the upper torso of the user in a generally upright disposition.

7. The leg press exercise machine of claim 1 wherein the backrest is pivotably mounted relative to the seat for adjustably positioning the backrest at a selected one of a plurality of angles relative to the seat.

8. The leg press exercise machine according to claim 1 wherein the first and second supports guide the first and second portions of the seat along first and second non-orthogonal linear paths.

9. The leg press machine according to claim 8 wherein the first portion of the seat structure reaches an apex of the first path and the second portion of the seat structure reaches a nadir of the second path as the seat structure travels from the first position to the second position.

10. The leg press machine according to claim 8 wherein the first portion of the seat structure reaches a nadir of the first path and the second portion of the seat structure reaches an apex of the second path as the seat structure travels from the second position to the first position.

11. The leg press machine according to claim 8 wherein the first portion of the seat structure reaches an apex of the first path and the second portion of the seat structure reaches an apex of the second path as the seat structure travels from the first position to the second position.

12. The leg press machine according to claim 8 wherein the first portion of the seat structure reaches a nadir of the first path and the second portion of the seat structure reaches a nadir of the second path as the seat structure travels from the second position to the first position.

13. The leg press exercise machine according to claim 1 further comprising a footplate adjustably mounted to the frame.

14. The leg press exercise machine according to claim 1 further comprising a resistance mechanism operably connected to the seat structure.

15. A leg press exercise machine for exercising a user's leg muscles, the exercise machine comprising:

a frame;

a seat structure comprising a seat for receiving and supporting a base of a back of the user in a seated position; and, a backrest extending from and arranged relative to the seat to receive and support an upper extension of the user's back;

wherein the seat and the backrest are translationally and pivotably movable together on the frame between a first position and a second position, the seat and the backrest rotating together during movement between the first and second positions a first portion of the seat structure travelling along a first linear support and a second portion of the seat travelling along a second linear support non-orthogonally disposed and arranged relative to the first linear support to rotate the seat structure during movement between the first and second positions.

16. The leg press exercise machine according to claim 15 wherein the seat and the backrest are mounted on a carriage mechanism at a preselected angular orientation relative to each other.

17. The leg press exercise machine according to claim 16 wherein the carriage mechanism is pivotably and translationally mounted on the frame.

18. The leg press exercise machine according to claim 16 wherein the backrest and the seat are adjustably positionable to one or more of a plurality of selectable angles relative to each other.

19. The leg press exercise machine according to claim 18, wherein the seat and the backrest recline on movement from the first position to the second position.

20. The leg press exercise machine according to claim 18, wherein the seat and the backrest incline on movement from the second position to the first position.

21. A leg press exercise machine for exercising a user's leg muscles comprising:

a frame including a first support structure comprising a first linear support defining a first linear path and a second support structure comprising a second linear support disposed non-orthogonally relative to the first linear support defining a second linear path;

a seat configured to support a base of the back of the user in a seated position and a backrest extending from the seat in an arrangement to support an upper extension of the back of the user, the seat and the backrest being mounted on a carriage in a selected angular relationship to each other;

wherein the carriage includes a first portion movably mounted on the first support structure and a second portion movably mounted on the second support structure;

the carriage being adapted to be moved from a first rest position to a second forcibly extended position along the first linear path and the second linear path such that the seat and the backrest declines as the carriage moves from the first position to the second position and inclines as the carriage moves from the second position to the first position;

the first and second support structures being arranged relative to each other in an orientation configured to rotate the seat and the backrest as the carriage moves from the first position to the second position.

22. A leg press exercise machine for exercising a user's leg muscles comprising:

a frame including a first support structure defining a first linear path and a second support structure defining a second linear path that intersects and is disposed non-orthogonally relative to the first linear path;

a seat configured to receive a base of the back of the user and a backrest extending from the seat in an arrangement to support an upper extension from the base of the back of the user such that the base and the extension of the back of the user are disposed in a seated position on the seat and the backrest, the seat and the backrest being mounted on a carriage in a selected angular relationship to each other;

wherein the carriage includes a first portion movably mounted on the first support structure and a second portion movably mounted on the second support structure;

the carriage being adapted to be moved from a first rest position to a second forcibly extended position along the first linear path and the second linear path such that the carriage pivots on the first support structure and the seat and the backrest rotate on movement between the first position and the second position.

* * * * *

UNITED STATES PATENT AND TRADEMARK OFFICE

CERTIFICATE OF CORRECTION

PATENT NO. : 7,727,128 B2
APPLICATION NO. : 11/582751
DATED : June 1, 2010
INVENTOR(S) : Giannelli et al.

It is certified that error appears in the above-identified patent and that said Letters Patent is hereby corrected as shown below:

At col. 8, line 50, after "positions" add a -- , --.

At col. 9, line 55, after "positions" add a -- , --.

Signed and Sealed this

Twentieth Day of July, 2010

David J. Kappos

David J. Kappos
*Director of the United States Patent and Trademark Office*